US006145552A

United States Patent [19]

Price et al.

[11] Patent Number: 6,145,552

[45] Date of Patent: Nov. 14, 2000

[54] PARTICULATE PRODUCT FOLLOWING SYSTEM AND METHOD

[75] Inventors: Richard T. Price, Lehi; Byron D. Larson, South Jordan, both of Utah

[73] Assignee: Multi-Fill, Inc., West Jordan, Utah

[21] Appl. No.: 09/397,594

[22] Filed: Sep. 16, 1999

[51] Int. Cl.[7] ..... B65B 43/42

[52] U.S. Cl. ..... 141/135; 141/129; 141/137; 141/157

[58] Field of Search ..... 141/62, 101, 135, 141/129, 137, 156, 157, 179, 250, 270, 283, 284; 222/526; 118/308, 323

[56] References Cited

U.S. PATENT DOCUMENTS

| | | | |
|---|---|---|---|
| 1,992,464 | 2/1935 | Blackman . | |
| 2,999,517 | 9/1961 | Cervinka | 141/137 |
| 3,065,775 | 11/1962 | Keves . | |
| 3,887,110 | 6/1975 | Porter | 141/157 |
| 4,678,015 | 7/1987 | Raque et al. | 141/137 |
| 4,733,803 | 3/1988 | Sisson et al. | 141/157 |
| 5,297,597 | 3/1994 | Herzog | 141/157 |
| 5,641,008 | 6/1997 | Ellis | 141/129 |
| 5,651,401 | 7/1997 | Cados | 141/129 |
| 5,823,234 | 10/1998 | Boetz | 141/67 |

*Primary Examiner*—Steven O. Douglas
*Assistant Examiner*—Khoa Huynh
*Attorney, Agent, or Firm*—Thorpe, North & Western, LLP

[57] ABSTRACT

A container following system for use with a particulate product measuring and dispensing machine having a discharge opening for allowing measured quantities of particulate product to drop therefrom into a moving container. The container following system comprises a following pocket disposed below the discharge opening of the particulate product measuring and dispensing machine and above a conveyor for moving containers to be filled. The following pocket comprises a reciprocating body having a generally vertical aperture through which particulate product drops from the discharge opening before landing in the container to be filled. The following pocket reciprocates in a direction generally parallel to the direction of motion of the container while product is dropping through the aperture, such that the product is caused to move in the direction of the moving container while dropping from the discharge opening to allow more accurate placement of the product in the container, and to allow higher line speeds for a given product and container combination. A method of filling containers with particulate product using the apparatus as described.

25 Claims, 4 Drawing Sheets

PARTICULATE PRODUCT FOLLOWING SYSTEM AND METHOD

BACKGROUND OF THE INVENTION

1. Field of the Invention

This invention relates to particulate product filling machines for packaging food products and the like. More particularly, the present invention relates to an improved following system for a particulate product filler which allows higher production line speeds while maintaining volumetric accuracy.

2. State of the Art

Particulate food products typically involve a variety of individual pieces mixed together, sometimes with a liquid or sauce. Examples of particulate food products include cooked rice, diced vegetables, stir fry vegetables, fruit pieces or fruit cocktail, and various pasta dishes. In the food processing industry, these products may be packaged in a wide variety of containers such as cups, trays, bottles, pouches, etc., which are formed of paper, plastic, or foil. However, the packaging of particulate food products requires special care to prevent large pieces—e.g., the noodles, fruit, or vegetables, etc.—from being chopped or mashed during packaging. For this reason, many of these types of food products are still portioned and packaged by hand. Such an operation typically involves a large number of workers each using a spoon or scoop to place a single portion of food in each container as it passes by on a conveyor. Obviously, this method presents several drawbacks. It involves substantial labor cost; portions tend to be irregular; there is the higher possibility of contamination of the food product by worker contact than with mechanical methods; and it presents a likelihood of fatigue and repetitive motion injuries to workers.

To avoid these sorts of problems, mechanical measuring and filling machines have been developed for particulate food products. These machines typically involve a measuring and discharge head which is positioned above a conveying device such as a conveyor belt. The conveyor moves empty open containers past the discharge head at some constant rate, and the product is portioned and dropped into each container as it passes by. The containers may move past more than one such machine if multiple products are to be placed therein, and then they typically proceed to an additional machine which places a top seal or cap on the container to seal it. These types of particulate product filling machines help ensure precise portion measurements, and also avoid the cost, cleanliness, and other drawbacks of hand packaging.

However, conventional particulate product packaging machines known in the art suffer from several drawbacks. First, in order to avoid damaging the product, it is usually allowed to flow from the machine into the open package purely under the force of gravity alone. Because direct mechanical force is not used to move the product, the speed at which the product can be placed into the container is thus limited by the physical characteristics of the product. For example, a viscous product such as spaghetti will discharge from the machine relatively slowly. The production line speed and output rate are thus limited because the conveyor carrying the containers can move past the machine outlet no faster than each discrete portion of the product can drop therefrom. Even when an air jet or other means is used to help discharge the product from the discharge opening, there is still a relatively low speed limit on the rate of production.

As an operative example, using conventional particulate product filling machines to place cooked rice of a given consistency, stickiness, etc. into containers having a 5" long opening, the containers being spaced out every 10" along a conveyor belt, the top speed of the line is approximately 73 containers per minute. Any higher speed begins to cause spillage, which not only causes contamination of the work environment, but, more importantly, contaminates the container edge, preventing a proper seal and resulting in wasted product. Obviously, this speed limit increases the cost and reduces the profitability of particulate product packaging operations.

To speed up the process, particulate product filling machines have been developed which employ a bucket follower system, or what is known as a walking beam or walking head system. These machines are often used for adding sauces to certain food products, and typically involve an assembly of buckets or other discharge apparatus which follow a container for some period of time as it moves along the conveyor. By briefly following the moving container, the window of time for discharge is increased relative to the conveyor speed, thus allowing a higher line speed.

However, bucket following systems do not solve all of the problems associated with particulate products, and introduce some additional problems as well. First, while bucket following systems can operate faster than static systems, they cannot do so and simultaneously provide a clean discharge, especially for sticky products such as cooked rice or spaghetti. Second, bucket following systems are inflexible because they are mechanically linked to the conveyor line, and speed up or slow down solely in response to the speed of the conveyor line. Because of this condition, they always place the product in the same place in the container. Changing the product placement would require the removal and replacement of many mechanical components such as cams, sprockets, gears, etc. Additionally, their speed cannot be adjusted based on, for example, a sudden change in container spacing, such as could occur if one of two lines supplying empty containers to the conveyor goes down. Third, bucket follower systems may involve anywhere from 2 to 20 or more buckets, all of which must be routinely cleaned, and which must each be removed and replaced whenever a product or container is changed, because each different container size and shape requires a different bucket. This makes the changeover from one product to another very time consuming.

It would therefore be desirable to have a particulate product filling apparatus which overcomes the discharge speed limitations of known particulate product filling machines, and also avoids the cleanliness and flexibility problems of bucket follower systems. Such a machine could accommodate faster line speeds for all types of particulate products without damaging the product or creating an unclean environment.

OBJECTS AND SUMMARY OF THE INVENTION

It is therefore an object of the present invention to provide a particulate product filling apparatus which can accommodate higher production line speeds for all types of particulate products and all types of containers, without damaging the product or contaminating the package.

It is another object of this invention to provide a particulate product filling apparatus in which the discharge timing is computer controlled so as to accommodate varying line speeds and container spacing during a production run without damaging the product or contaminating the packaging.

It is another object of this invention to provide a particulate product filling apparatus in which the discharge timing is computer controlled so as to allow selective placement of the product within the container.

It is another object of this invention to provide a particulate product filling apparatus in which the discharge characteristics are easily modified for changeover from one type of product or container to another.

The above and other objects are realized in a preferred embodiment of a container following system for use with a particulate product measuring and dispensing machine having a discharge opening for allowing measured quantities of particulate product to drop therefrom into a moving container. A following pocket is disposed below the discharge opening of the particulate product measuring and dispensing machine and above a conveyor for moving containers to be filled. The following pocket comprises a generally vertical aperture which is configured such that particulate product discharged from the discharge opening drops through the aperture before dropping into the container to be filled. The aperture may be configured in various shapes to accommodate containers of various shapes. The follower pocket is configured to slidably reciprocate in a direction generally parallel to the direction of motion of the container by means of a pneumatic actuator which is preferably controlled by a microprocessor controller which also controls the product measuring and dispensing machine. The controller causes the following pocket to move in the direction of motion of the container while particulate product is being discharged from the discharge opening and passing through the aperture, such that the particulate product is caused to move in the direction of the moving container while dropping from the discharge opening.

Some of the above objects are also realized in a particulate product measuring and dispensing machine wherein the pneumatic drive system is variably actuable, such that its speed, direction of motion, and stroke length may be precisely controlled by the microprocessor controller. The microprocessor controller may be selectively adjusted to control the speed and timing of reciprocation of the following pocket and the actuation means synchronously with the operation of the particulate product measuring and dispensing machine so as to place the particulate product precisely into a desired location within the container. Sensors may also be provided for detecting the position of a container to be filled relative to the particulate product filling machine and the following pocket, the microcomputer receiving a signal from the sensors representing the position of the container to allow adjustment of the motion of the actuating means relative to the moving container and the particulate product filling machine so as to allow precise placement of the particulate product in the desired location within said container.

These and other objects are also realized in a method of filling containers with a particulate product by means of the particulate product measuring and dispensing machine. Other objects and features of the present invention will be apparent to those skilled in the art, based on the following description, taken in combination with the accompanying drawings.

DETAILED DESCRIPTION OF THE PREFERRED EMBODIMENT

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
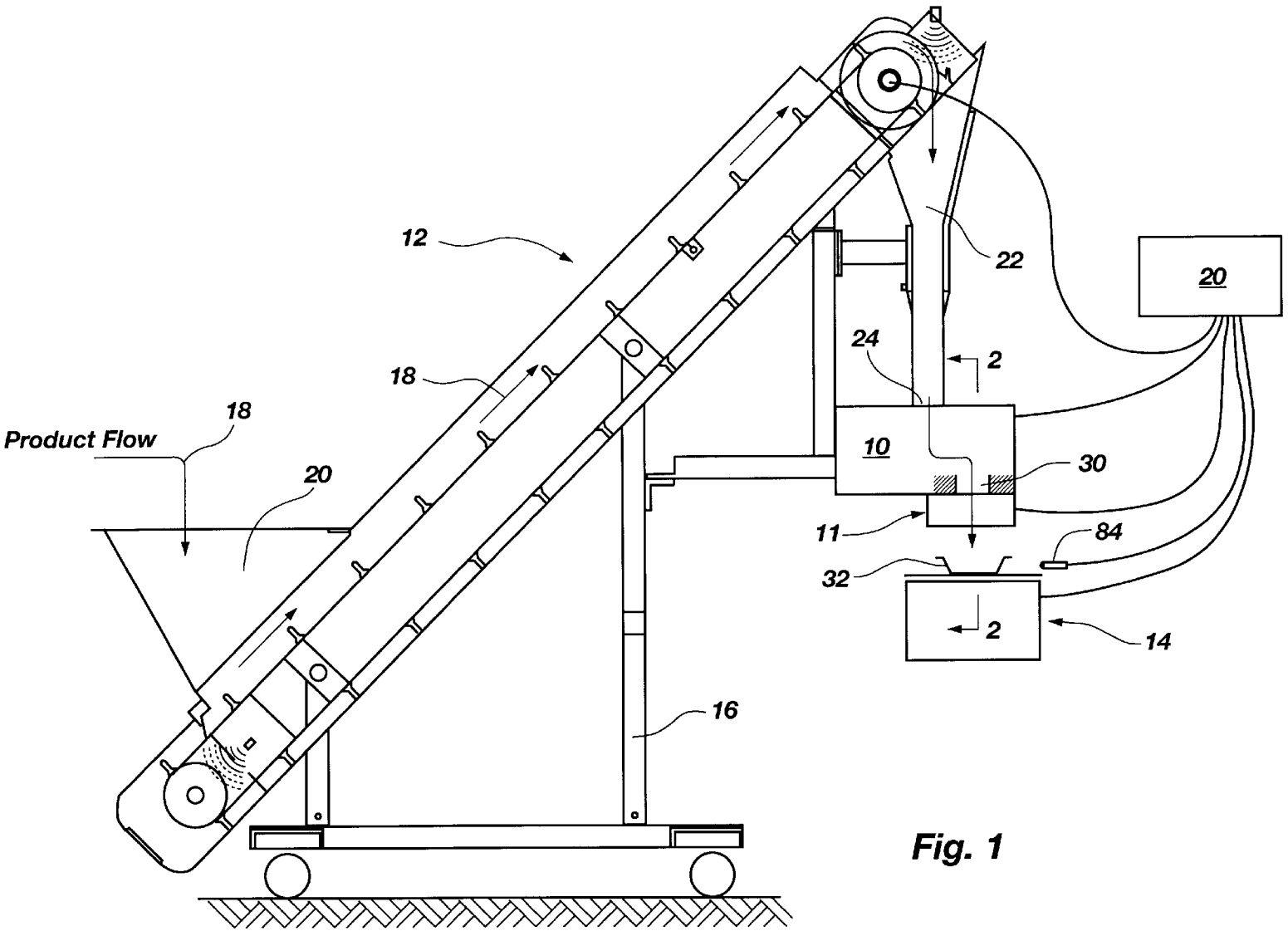
FIG. 1 depicts a particulate product measuring and filling machine in operational relationship with a supply conveyor and container conveyor.

The present invention is best suited for use in conjunction with a particulate product filling system, such as shown in FIG. 1, comprising a particulate product measuring and filling machine 10, a supply conveyor 12, and container conveyor 14. The particulate product measuring and filling machine 10 is an apparatus for measuring and isolating a discrete quantity of the particulate product. In the view of FIG. 1, the filling machine is shown in longitudinal cross-section, the cross-section taken perpendicular to the direction of travel of the container conveyor 14, which moves into or out of the plane of the drawing. As depicted, the supply conveyor 12 is mounted on a moveable frame 16, to which the measuring and filling machine is also connected. This configuration allows multiple filling machines 10 to be conveniently located and relocated relative to the container conveyor so as to accommodate operations such as multiple product dispensing into multiple compartment containers and so forth, as is well known in the industry.

The path of the particulate product during operation of the particulate product filling machine 10 is indicated by arrows 18. In operation, the conveyor 12 draws product out of a supply hopper 20, and drops it into filler tube 22, which directs the product into the inlet 24 of the measuring and filling machine 10. The filling machine mechanically measures a discrete quantity of the product, then allows the product to drop through a discharge opening or discharge pocket 30 and into a container 32 located directly below on the container conveyor 14. The operation of the various components of this product measuring and filling machine may be controlled by direct mechanical interconnection of the components so as to ensure synchronous operation like clockwork. Alternatively, the components may be controlled by a combination of servo systems, detectors, and actuators, which allow synchronous operation. As still another and preferred alternative, the operation of the various components may be controlled by a microprocessor 80, to be described in more detail below.

As will become more apparent hereafter, the particulate product measuring and filling machine 10 may take a variety of configurations other than that shown. Moreover, the particulate product following system of the present invention does not require a mechanical product measuring and filling apparatus at all, but may instead be supplied with particulate product by means of manual labor wherein workers place a measured portion of product directly into an outlet conduit.

Given the prior art elements described above, assuming that the product supply conveyor 12 and particulate product measuring and dispensing machine 10 are capable of operating at essentially any desired speed, it will be apparent that the speed with which containers can be filled is dependent on the maximum speed at which the product will drop from the discharge pocket 30. As noted above, this drop speed is a characteristic of the product itself, and thus limits the maximum linear speed of the container conveyor line 14.

Advantageously, instead of a mere stationary outlet conduit as in the prior art, the present invention further comprises a follower pocket assembly 11 disposed below the discharge pocket 30, which directs the product to the container and allows faster filling of containers while still providing a clean discharge and accurate fill position in the container. The details of operation of this follower pocket are described in detail with reference to FIGS. 2A–2C which present transverse cross-sectional views of the particulate product following system taken along section line 2—2 through the centerline of the discharge pocket 30 as depicted in FIG. 1.

Figure 2A:
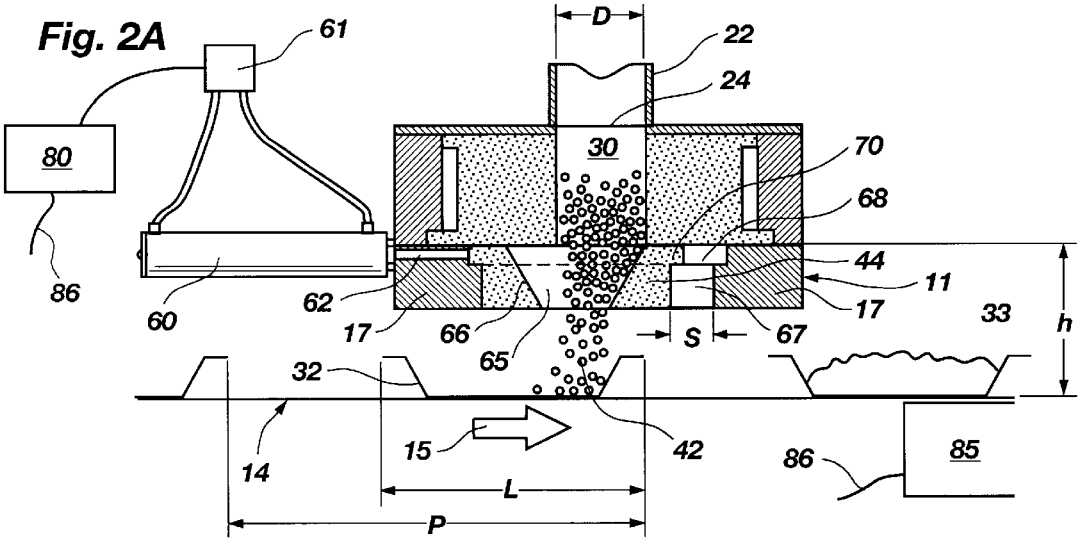
FIG. 2A is a transverse cross-sectional view of the particulate product following system of the present invention showing the follower pocket retracted in preparation to receive the product at the beginning of discharge.
Figure 3:
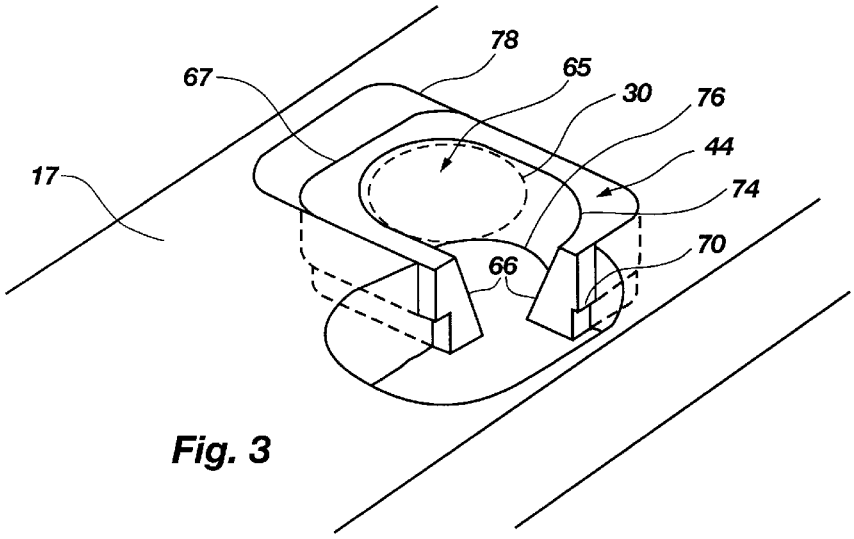
FIG. 3 provides a pictorial, partial sectional view of a follower pocket according to the present invention.

As shown in FIG. 2A, the follower pocket assembly 11 comprises a reciprocating follower pocket 44 which is configured to move in the direction of the container conveyor 14, shown by arrow 15, during the discharge phase of the particulate product filling machine 10. FIG. 2A depicts the follower pocket 44 retracted in preparation to receive the product from the discharge pocket 30 at the beginning of the discharge phase. FIG. 3 provides a pictorial, partial sectional view of a follower pocket 44 according to the present invention. The follower pocket 44 generally comprises a substantially solid rectangular body having a flange 70 disposed about its upper perimeter, and a discharge opening 65 formed in its center. The follower pocket 44 rests on its flanges 70 upon a ledge 68 formed in an opening 67 provided in the follower pocket base 17. The opening 67 is longer than the follower pocket 44 as shown by line 78 in FIG. 3 to provide room for it to reciprocate therein.

Returning to FIG. 2A, reciprocal linear motion of the follower pocket 44 within opening 67 is provided by actuator 60 which moves shaft 62 which extends through an opening in the side of the elongate base 17 and is releasably connected to the follower pocket 44. This configuration allows quick, easy removal and replacement of the follower pocket 44, such as when changing over the line to prepare to package a new product. Replacement of the follower pocket 44 generally takes less than one minute, whereas changing multiple buckets on a bucket follower machine may take more than an hour, causing significant costly down time.

The actuator 60 is preferably a pneumatic cylinder, as shown in FIG. 2A. However, it will be appreciated that other linear actuation devices may be used with this invention which still allow independent control, such as an electric servo motor with a ball and screw mechanism, a solenoid, a hydraulic cylinders, a motor and cam assembly, or other electrical or mechanical devices. The follower pocket could also be mechanically connected to the conveyor 14, to ensure synchronous reciprocation. However, of all possible alternatives, a pneumatic actuator is presently preferred because of its fast reaction speed, low operating temperature, and because its motion may be precisely controlled.

The pneumatic cylinder 60 is connected to a pneumatic actuator 61, which in turn is controlled by the controller 80, to be described in more detail below. The timing, stroke length s (the length of reciprocal travel of the follower pocket 44), and speed of motion of the follower pocket are preferably selectively controlled by the controller 80 to synchronize with the other components of the filling system 11. It will be apparent that this timing will depend on the length L of the container to be filled the pitch P between containers on the conveyor, the dimension D of the discharge pocket 30, and the drop height h measured from the top of the follower pocket 44 to the bottom of the container 32. The measurement of all of these physical parameters are shown in FIG. 2A. It will be apparent that the stroke length s of the follower pocket depends on the total length of the opening 67, and the point at which the extension of the pneumatic shaft is caused to stop by the controller 80.

The discharge pocket 30 may be any shape, such as circular, eliptical, oval, rectangular, etc. in cross-section. It will be apparent that the discharge pocket is preferably the same shape as the filler tube 22, such as having a circular dimension D, representing a diameter as indicated in FIG. 2A. The cross-section of the discharge pocket opening is represented by hidden line 30 in FIG. 3. However, the central opening 65 of the follower pocket 44 preferably comprises at its top an oblong shape 74 which is elongated in the direction of motion of the conveyor 14. The lower end 76 of the opening 65 may be any desired shape, such as round as shown in FIG. 3. It will be appreciated that the ends of the oblong opening 74 should have a radius equal to the radius of the discharge pocket 30. This configuration allows the follower pocket opening 65 to mate with the discharge pocket 30 at all stages of its reciprocation.

Figure 2B:
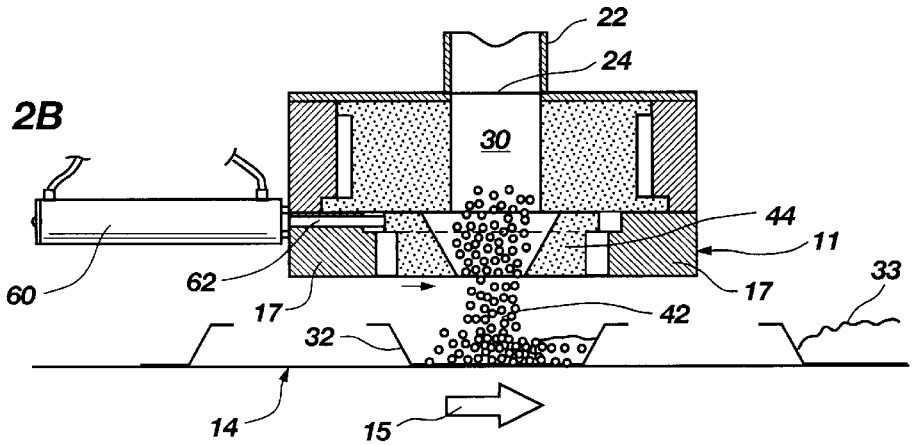
FIG. 2B is a transverse cross-sectional view of the particulate product following system of the present invention showing the follower pocket partially extended during the discharge phase so as to follow the product container.
Figure 2C:
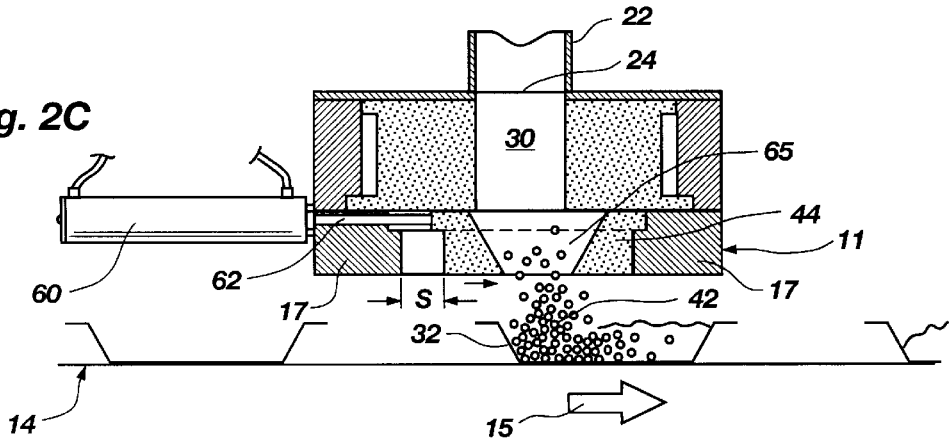
FIG. 2C is a transverse cross-sectional view of the particulate product following system of the present invention showing the follower pocket completely extended during the discharge phase so as to allow the entire product portion to drop into the moving product container.

It will be apparent that with the top 74 of opening 65 having a different shape than the bottom 76, the sides 66 of the central opening 65 will be sloped in some manner. The inner sides 66 of opening 65 preferably have fore and aft sides which slope toward the center of the follower pocket, from top to bottom, as shown in the cross-sectional views of FIGS. 2A–2C. This configuration functions to direct the falling product 42 contrary to the direction of motion of the conveyor 14 at the beginning of the discharge phase, when the container is generally behind the discharge opening (FIG. 2A), and helps push the falling product in the direction of motion of the conveyor 14 at the end of the discharge phase when the container is ahead of the discharge opening (FIG. 2C). FIG. 2B shows the follower pocket 44 partially extended during the discharge phase so as to follow the product container 32 as it moves along the conveyor 14. FIG. 2C shows the follower pocket 44 completely extended to the opposite end of the opening 67 at the end of the discharge phase so as to allow the entire product portion to drop into the moving product container 32. Following complete discharge, the follower pocket retracts to the position of FIG. 2A, to await the next discharge.

To accommodate the operation of the particulate product measuring and filling machine 10 and obtain desired line speeds, the entire reciprocal motion cycle of the follower pocket 44 will take place during the discharge phase of the product filler, which may comprise only a fraction of a second. This rapid motion of the follower pocket is preferably controlled and timed by means of the controller 80, which presents several advantages over the prior art. By using a microprocessor controller, the follower pocket can be caused to extend and retract very rapidly or very slowly. Rapid extension can help the product to drop and dislodge more quickly by "throwing" it in the direction of the moving container toward the end of the discharge phase. The follower pocket can also be caused to extend only part way, or in short bursts. A partial extension will increase the length of the drop relative to the container, allowing placement of product in a long line, if desired, while short bursts create a vibrational effect which helps evacuate the product from the opening 65.

All of these operational alternatives allow the particulate product filling machine to follow the container during the discharge phase, so as to effectively increase the window of time in which the container is located opposite the discharge, and to allow more precise placement of the product in the container while avoiding the cleanliness problems of bucket follower systems. An illustrative example involving cooked rice will help demonstrate the improvement in speed allowed by the present invention. The following parameters will be considered:

Container Length L=5"

Container Pitch P=10"

Dia. of Discharge Pocket D=3"

Drop Distance h=5"

Product Drop Time t=0.164 sec.

Assuming the cooked rice involved is relatively non-sticky, the maximum rate at which the containers can be filled is 73 containers per minute (cpm) using the prior art particulate product filler 10 under these operating parameters. However, using the same parameters with a container following system 11 according to this invention, the same containers can be filled at a rate of 110 cpm with a follower pocket having a 1" stroke moving at approximately the same or greater speed than the container conveyor. This represents an approximately 50% speed increase. It will be apparent that providing a longer follower pocket stroke could allow even greater speed increases. The values given here for illustration only, and naturally depend upon the unique and somewhat variable characteristics of the cooked rice. These results also depend upon the specific shape of the follower pocket aperture. For example, a tapered follower pocket can increase the speed of the discharge in certain circumstances.

Figure 4A:
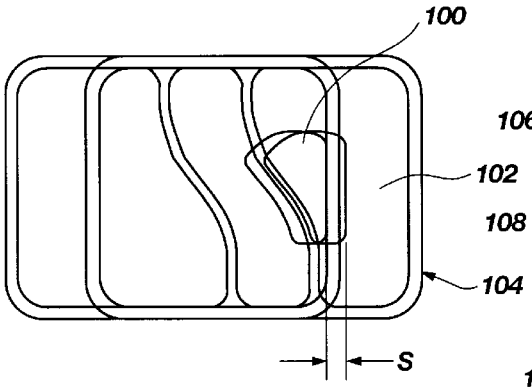
FIG. 4A shows the increase in the drop window and line speed for placing a generally triangular mass of product in the center of the right hand compartment of a rectangular two compartment tray using a following pocket having a stroke of 0.5 inches.
Figure 5A:
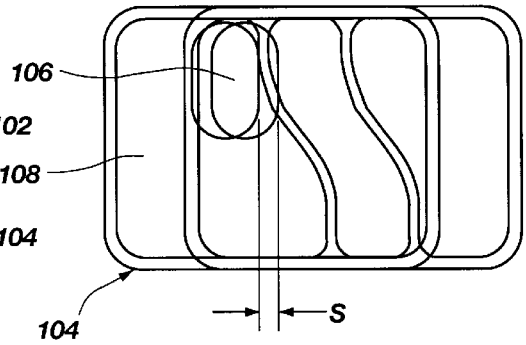
FIG. 5A shows the increase in the drop window and line speed for placing a generally oblong mass of product at one side of the left hand compartment of a rectangular two compartment tray using a following pocket having a stroke of 0.5 inches.
Figure 4B:
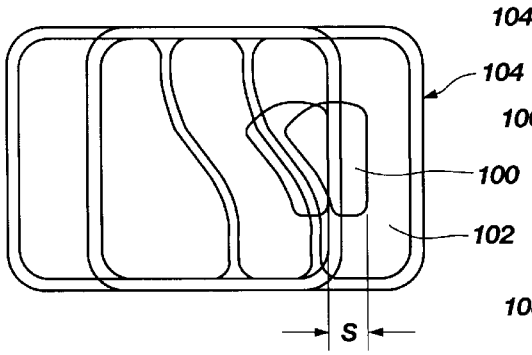
FIG. 4B shows the increase in the drop window and line speed for placing a generally triangular mass of product in the center of the right hand compartment of a rectangular two compartment tray using a following pocket having a stroke of 1.0 inch.
Figure 5B:
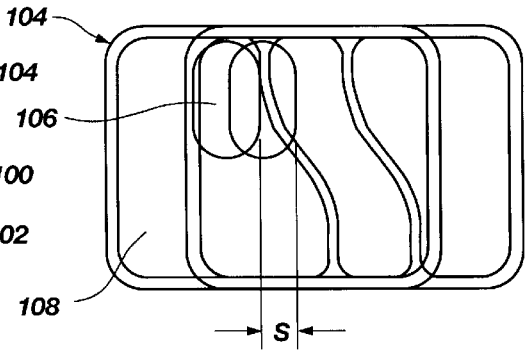
FIG. 5B shows the increase in the drop window and line speed for placing a generally oblong mass of product at one side of the left hand compartment of a rectangular two compartment tray using a following pocket having a stroke of 1.0 inch.
Figure 6A:
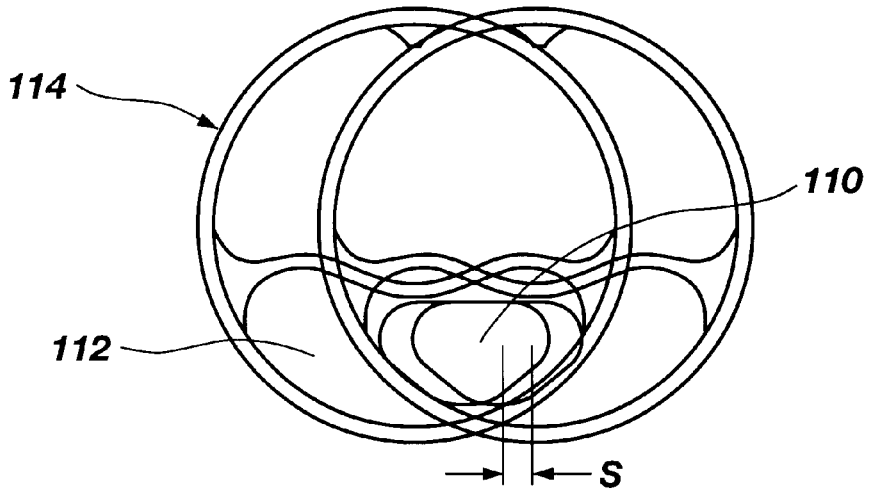
FIG. 6A shows the increase in the drop window and line speed for placing an oblong triangular mass in a narrow bottom compartment of a round two compartment tray using a following pocket having a stroke of 0.5 inches.
Figure 6B:
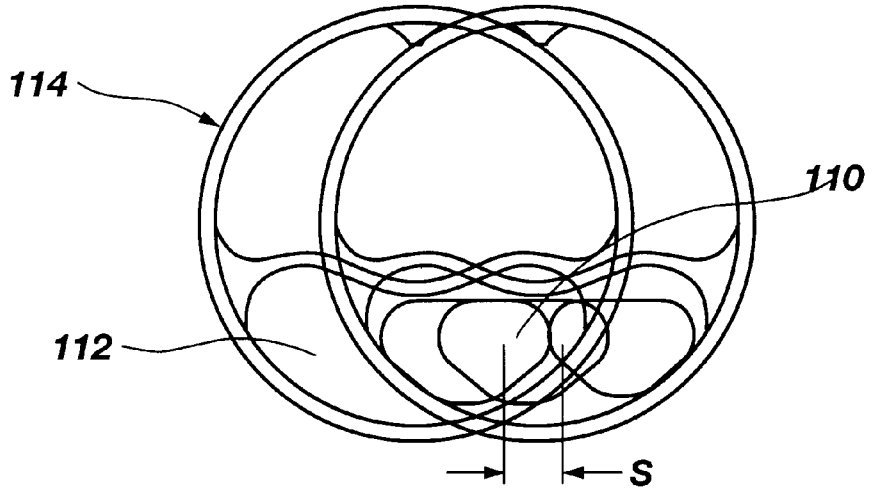
FIG. 6B shows the increase in the drop window and line speed for placing an oblong triangular mass in a narrow bottom compartment of a round two compartment tray using a following pocket having a stroke of 1.0 inch.

FIGS. 4A & B, 5A & B, and 6A & B provide examples of how the speed of product discharge for an arbitrary product can be increased for containers of various shapes where placement of the product in a specific location and in a specific shaped mass is required. FIGS. 4A, 5A, and 6A show the available speed of discharge using a following pocket having a stroke of s=0.5." FIGS. 4B, 5B, and 6B show the same for a follower pocket having a stroke of s=1.0." It will be apparent that the shape of the bottom of the follower pocket opening 65 will necessarily depend on the desired shape of the product mass in the container. For example, FIG. 4 shows the placement of a generally triangular mass 100 in the center of the right hand compartment 102 of a rectangular two compartment tray 104. In FIG. 4A, with a follower pocket stroke of 0.5", a speed of 69 containers per minute (cpm) is possible. However, if FIG. 4B, with the same product and the same container, the possible speed increases to 86 cpm with a 1.0" stroke.

FIG. 5 shows the placement of an oval or oblong mass 106 at one side of the left hand compartment 108 of the two compartment tray 104. In FIG. 5A, with a follower pocket stroke of 0.5", the highest possible speed is 87 cpm. However, when the stroke length is increased to 1.0", the speed increases to 105 cpm. Likewise, in FIG. 6A, requiring the placement of an oblong triangular mass 110 in a narrow bottom compartment 112 of a round two compartment tray 114, with a stroke of 0.5" the line speed is 84 cpm. However, when the stroke length is increased to 1.0", the available line speed increases to 100 cpm.

It will be apparent that where such accurate placement is required, extremely precise control of the product discharge is necessary. This precise product discharge control is advantageously provided by the controller 80. The operation of the components of the particulate product filler 10 and follower pocket assembly 11 as shown in FIG. 1 is preferably controlled by the microprocessor controller 80, which is also connected to the supply conveyor 12, the container conveyor 14, a container sensor 84, and the other components of the particulate product filling system. The sensor 84 may be an optical sensor as shown, or may comprise a magnetic sensor, a mechanical sensor which physically touches the container, or any other known type of sensor which can detect the presence of a container. Because the actuation of all of the above mentioned components is controlled by the controller 80, the timing of motion can be automatically adjusted based on the speed and position of the container on the conveyor, which may also be adjusted by the controller, and the type and desired placement of the product. As depicted in FIG. 2A, the system may also include a volume sensing and feedback system, such as a scale 85 for weighing the filled containers while in motion on the conveyor, and transmitting this information to the controller 80 via communication lines 86. This configuration allows the controller to automatically adjust the functioning of the particulate product measuring and filling machine 10 and the follower pocket assembly 11 based on the output volume as measured by the scale.

The controller 80 is preferably a computer microprocessor which is advantageously programmed with all physical formulas and data necessary for it to calculate the required timing and speed of motion of all components for a variety of products so as to precisely place the product in the container when and where desired. For example, if the container spacing should suddenly increase, the container sensor 84 can detect that, and the controller will automatically delay the timing of the next product drop. Similarly, if it is desired to place the product at the front or back of the container, not in the center, the controller can delay the action of the product measuring and filling machine 10 and the motion of the follower pocket 44 to delay the drop. Such precise timing control and flexibility is not possible with other product filling devices where the parts are mechanically linked to the conveyor line and cannot vary their motion relative to the conveyor.

It will be apparent to those skilled in the art that other types of controllers may be adapted to control the components of the particulate product filler of this invention. For example, an electromechanical controller incorporating electronic indicators, servos, and control switches could be adapted to receive the signals from the various components and allow a user to selectively synchronize the operation of these components for optimal product placement. However, a microcomputer is preferred because of its ease of use and flexibility. If it is desired to change the parameters of operation of the system, such changes can be easily made through a standard computer terminal connected to the controller 80. For example, if the product consistency or viscosity were to change during a single production run, the timing of the various components of the system could be modified "on-the-fly" by adjusting certain values through the computer interface without requiring production to stop even for a few minutes.

The present invention also adds an additional element which greatly enhances the benefits of this system. As noted above, the pneumatic controller 60 of the follower pocket 44 is controlled by the same controller 80 which controls the motion of all other components. This allows the specialized software of the controller to precisely time the motion of the follower pocket, and to quickly adjust to new operating parameters, or vary them as desired. For example, by simply putting new information into the controller terminal, an operator can change the direction of the line, can adjust the discharge volume, and can even instruct the system to adjust to a new product. Unlike the prior art, these changes do not require adjustment of the system by trial and error through costly and wasteful repeated brief start-ups and shut-downs, nor does it require the complex and time consuming removal and replacement of multiple mechanical components. At the same time, it provides a particulate product filling system which has significantly higher operating speeds than the prior art.

The particulate product following system described above provides several other operational benefits. For example, the follower pocket system may be used with a line that does not move continuously. In such a system, when the container is stopped under the filling head, the follower pocket can then move from one end to the other to spread the product within the container. Alternatively, on slow moving lines, this system can be configured to move in a direction opposite to the direction of the line to spread the product within the container.

The above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A container following system for placing measured quantities of particulate product into a moving container, comprising:

a following pocket adapted to be disposed below a discharge opening of a particulate product measuring and dispensing machine and above a moving container, the following pocket configured for moving from a first to a second position while simultaneously discharging particulate product into the moving container; and a movement actuator connected to the following pocket for moving the following pocket in a variable motion wherein direction and timing of the motion of the following pocket are independently adjustable relative to the motion of the container.

2. The container following system as described in claim 1 wherein;

the following pocket has a vertical axis and a generally vertical aperture therethrough, and is configured such that particulate product discharged from the discharge opening drops through the aperture in the process of dropping into the container, the following pocket being configured for slidable reciprocation in a direction generally perpendicular to the vertical axis and generally parallel to the direction of motion of the container;

and further comprising:

control means connected to the following pocket, the movement actuator, and the product measuring and dispensing machine for causing the following pocket to move in the direction of motion of the container while particulate product is being discharged from the discharge opening and passing through the aperture such that the particulate product is caused to move in the direction of the moving container while dropping from the discharge opening.

3. The container following system as described in claim 2 wherein the control means comprises a microcomputer.

4. The container following system as described in claim 3 wherein the microcomputer controls the speed and timing of reciprocation of the following pocket and the movement actuator synchronously with the operation of the particulate product measuring and dispensing machine, so as to place the particulate product into a desired location within the container.

5. The container following system as described in claim 2 wherein the control means comprises:

sensor means for detecting the position of a container to be filled relative to the particulate product filling machine and the following pocket;

a microcomputer for receiving a signal from the sensor means representing the position of the container to be filled and for adjusting the motion of the movement actuator relative to the moving container and the particulate product filling machine based upon the signal so as to allow precise placement of the particulate product in a desired location within the container.

6. The container following system as described in claim 5 wherein the microcomputer is programmed to selectively actuate the pneumatic drive system to precisely control the speed, direction of motion, and stroke length of the following pocket.

7. The container following system as described in claim 5 wherein the microcomputer is programmed to selectively actuate the pneumatic drive system so as to move the following pocket in the direction of motion of the container in a series of rapid short bursts of motion while the moving container is therebelow, such that the following pocket is effectively caused to move more slowly than otherwise, and also thereby inducing vibration into the structure of the following pocket whereby the particulate product is assisted in dropping from the discharge opening into the container.

8. The container following system as described in claim 5 wherein the microcomputer is programmed to selectively actuate the pneumatic drive system so as to move the following pocket in the direction of motion of the container less than a full stroke, whereby the physical length and time duration of the following pocket stroke is less than a full stroke.

9. The container following system as described in claim 2, wherein the aperture in the following pocket comprises a top opening configured for alignment with the discharge opening throughout the reciprocation of the following pocket.

10. The container following system as described in claim 9, wherein the aperture in the following pocket further comprises:

a top opening which is substantially oblong in shape and having an elongate axis generally parallel to the direction of motion of the container; and a bottom opening which is substantially smaller than the top opening when measured along the elongate axis of the top opening, such that the aperture comprises interior sidewalls which form forwardly and backwardly sloped end surfaces for directing falling particulate product away from or into the direction of motion of the container.

11. The container following system as described in claim 1 wherein the movement actuator comprises a pneumatic drive system.

12. The container following system as described in claim 11 wherein the pneumatic drive system is variably actuable, such that its speed, direction of motion, and stroke length may be precisely controlled.

13. The container following system as described in claim 1, further comprising:

a particulate product measuring and dispensing machine having a discharge opening, and configured for measuring and isolating discrete quantities of particulate product, and dropping said discrete quantities through the discharge opening and into the following pocket;

a conveyor for moving containers past the particulate product measuring and dispensing machine below the discharge opening and the following pocket; and a controller for controlling the functioning of the particulate product measuring and dispensing machine, the conveyor, and the motion of the movement actuator.

14. A container following system for placing measured quantities of particulate product into a moving container, comprising:

a following pocket adapted to be disposed below a discharge opening of a product measuring and dispensing machine and above a moving container, the following pocket configured for moving from a first to a second position while simultaneously discharging particulate product into the moving container; and an actuator connected to the following pocket for moving the following pocket in a variable motion wherein direction and timing of the motion of the following pocket are independently adjustable relative to the motion of the container.

15. A particulate product measuring and dispensing system for dispensing particulate product into containers to be filled, the system being disposed above a conveyor device for moving containers to be filled, and comprising:

a particulate product measuring and dispensing machine comprising:

an inlet for receiving particulate product;

a measuring apparatus disposed adjacent to the inlet for measuring and isolating a discrete quantity of the particulate product;

a discharge opening disposed adjacent the measuring apparatus for receiving the discrete quantity of particulate product and allowing it to drop therethrough;

a following pocket disposed below the discharge opening and above the conveyor, the following pocket having a top opening, a bottom opening, a vertical axis, and an aperture formed between the top opening and the bottom opening and oriented generally parallel to the vertical axis, such that particulate product discharged from the discharge opening drops through the aperture in the process of dropping into the container, the following pocket being configured for moving below the discharge opening, the top opening being configured for alignment with the discharge opening throughout said motion;

an actuator connected to the following pocket for selectively causing variable motion of the following pocket; and a controller connected to the conveyor, the particulate product measuring and dispensing machine, and the actuator, and configured for controlling the direction and timing of the motion of the following pocket independent of the motion of the container.

16. The particulate product measuring and dispensing system as described in claim 15, further comprising volume sensing means for detecting the volume of particulate product discharged into a container, the volume sensing means being connected to the controller so as to provide feedback indicating the volumetric output accuracy of the particulate product measuring and dispensing machine, whereby the volume of product isolated and measured by the measuring apparatus may be adjusted by the controller.

17. The particulate product measuring and dispensing system as described in claim 16 wherein the volume sensing means comprises a scale for weighing filled containers while in motion on the conveyor.

18. The particulate product measuring and dispensing system as described in claim 15 wherein the controller further comprises:

a sensor for detecting the position of a container to be filled on the conveyor relative to the product measuring and dispensing system; and a microcomputer for receiving a signal from the sensor representing the position of the container to be filled and for adjusting the functioning of the measuring apparatus and the actuator according to a preprogrammed algorithm so as to allow precise placement of the particulate product in the container.

19. A method of filling a container with a controlled volume of particulate product comprising the steps of:

(a) placing at least one container to be filled with a particulate product upon a linearly moving conveyor;

(b) isolating and measuring a discrete quantity of particulate product by means of a particulate product measuring and dispensing machine having a discharge opening disposed above the conveyor;

(c) sensing the location of the container to be filled relative to the discharge opening;

(d) dropping the particulate product through the discharge opening approximately when the container to be filled is disposed therebelow; and (e) actuating a following pocket having independently adjustable direction and timing of motion relative to the motion of the container on the conveyor, and disposed below the discharge opening and above the container to cause the following pocket to move variably while the particulate product is falling therethrough and the container is therebelow.

20. The method described in claim 19 further comprising the steps of:

(g) weighing the filled container after the particulate product has been dispensed thereinto for detecting the volume of particulate product discharged into the container;

(h) providing feedback to a controller indicating the volumetric output of the particulate product measuring and dispensing machine; and (i) adjusting by means of the controller the discrete quantity of product isolated and measured by the particulate product measuring and filling device for a subsequent container.

21. The method described in claim 20 wherein step (g) more particularly comprises weighing the filled container while in motion on the conveyor.

22. The method described in claim 19, further comprising the step of controlling the timing and speed of motion of the conveyor, the particulate product measuring and filling device, and the following pocket by means of a microprocessor controller utilizing specialized software programmed therein.

23. The method described in claim 19 wherein the step of actuating the following pocket to cause it to move comprises the step of:

(j) moving the following pocket in the direction of motion of the container in a series of rapid short bursts of motion while the container is therebelow, such that the following pocket is caused to effectively move more slowly than otherwise, and also thereby inducing vibration into the structure of the following pocket whereby the particulate product is assisted in dropping from the discharge opening into the container.

24. The method described in claim 19 wherein the step of actuating the following pocket to cause it to move comprises the step of:

(k) moving the following pocket in the direction of motion of the container less than a full stroke, whereby the physical length and time duration of the following pocket stroke is less than a full stroke.

25. The method described in claim 19 further comprising the step of:

(f) repeating steps (a) through (e) for subsequent containers.

* * * * *